United States Patent [19]

Hardin

[11] 4,420,921

[45] Dec. 20, 1983

[54] BUILDING SPACER

[76] Inventor: Isaac H. Hardin, General Delivery, Lexington, Ind. 47138

[21] Appl. No.: 367,741

[22] Filed: Apr. 12, 1982

[51] Int. Cl.[2] ..... E04F 21/00; B43I 13/00

[52] U.S. Cl. ..... 52/749; 33/180 R; 269/43

[58] Field of Search ..... 33/180 R; 269/43, 228; 52/749, 750

[56] References Cited

U.S. PATENT DOCUMENTS

| | | | |
|---|---|---|---|
| 1,057,799 | 4/1913 | Bowerman | 144/288.5 |
| 2,567,586 | 9/1951 | Werder | 33/174 |
| 2,686,959 | 8/1954 | Robinson | 33/180 R |
| 2,744,334 | 5/1956 | Jondole | 33/180 R |
| 3,083,007 | 3/1963 | Campfield | 269/151 |
| 3,168,305 | 2/1965 | Lee | 269/321 |
| 3,189,341 | 6/1965 | Maurus | 269/153 |
| 3,201,874 | 8/1965 | Christy | 33/180 R |
| 3,663,004 | 5/1972 | Hupert | 269/157 |
| 3,834,033 | 9/1974 | Pinkard | 33/174 G |
| 3,888,477 | 6/1975 | Tate | 269/82 |
| 4,212,108 | 7/1980 | Jackson | 33/174 G |
| 4,237,614 | 12/1980 | Williams | 269/43 |
| 4,241,906 | 12/1980 | Cole | 269/43 |
| 4,322,064 | 3/1982 | Jarvis | 33/180 R |

*Primary Examiner*—James L. Ridgill, Jr.

*Attorney, Agent, or Firm*—Cushman, Darby & Cushman

[57] ABSTRACT

A spacing tool provides for the positive holding and spacing of structural members, such as 2×4s, that is simple and easy to use and positively holds the structural members in place for nailing or fastening, while straightening any bows or twists therein. First and second jaw assemblies each include a pair of jaws extending from a first end thereof, the jaws of each pair being spaced from each other a fixed distance. A locking lever is disposed between the jaw assemblies second ends, and is pivotally mounted to the jaw assemblies to move them from a second, unlocked position wherein they are not in-line and the jaws are not spaced from each other a fixed, predetermined distance, to a first, locked position where they are substantially in-line and overlap and the jaws are spaced from each other a fixed predetermined distance to space structural members.

10 Claims, 3 Drawing Figures

BUILDING SPACER

BACKGROUND AND SUMMARY OF THE INVENTION

The invention relates to a tool for holding and spacing structural members. The invention is particularly useful in the building trades for holding and properly spacing studs for nailing to ceiling and floor joists, or bridges, or fastening to plates and sills. The invention also has application to the handling of large timbers, metal girders and rails, and the like, and all types of building trades.

In its preferred form, the invention is ideally suited for use by a single worker, and simply and effectively performs its spacing and holding functions. The tool can be made lightweight, and may be used by a single worker to positively move structural components into place onsite, while straightening any bows or twists that may exist therein.

The three major components of the tool according to the invention are a first jaw assembly, a second jaw assembly, and a locking lever. The first jaw assembly includes a linear body portion and a pair of stationary first jaws spaced from each other a fixed predetermined distance, and extending parallel to each other in the same direction from the first end of the body portion. The second jaw assembly also includes a linear body portion and a pair of stationary second jaws. The first jaw assembly body portion is bifrucated, and the second jaw assembly body portion has a central portion. The locking lever includes a bifrucated body portion, the arms of the locking lever being received between the arms of the first jaw assembly, and the central portion of the second jaw assembly being received between the arms of the locking lever.

The arms of the locking lever are pivotally mounted to the first jaw assembly arms, and to the second jaw assembly central portion. The pivot points are such that the jaw assemblies are movable from a first, locked position wherein the central portion of the second jaw assembly is between the arms of the first jaw assembly and the first and second jaws are spaced a fixed predetermined distance from each other, to a second, unlocked position wherein the central portion of the second jaw assembly is exterior of the arms of the first jaw assembly, and the first and second jaws are not spaced a fixed predetermined distance from each other. An over-center action is provided as the locking lever moves the jaw assemblies to the first, locked position, with a pair of stops fixed to the first jaw assembly stopping further movement of the locking lever.

It is the primary object of the present invention to provide a simple and effective tool for spacing and holding structural members. This and other objects of the invention will become clear from an inspection of the detailed description of the invention, and from the appended claims.

DETAILED DESCRIPTION OF THE DRAWINGS

Figure 2:
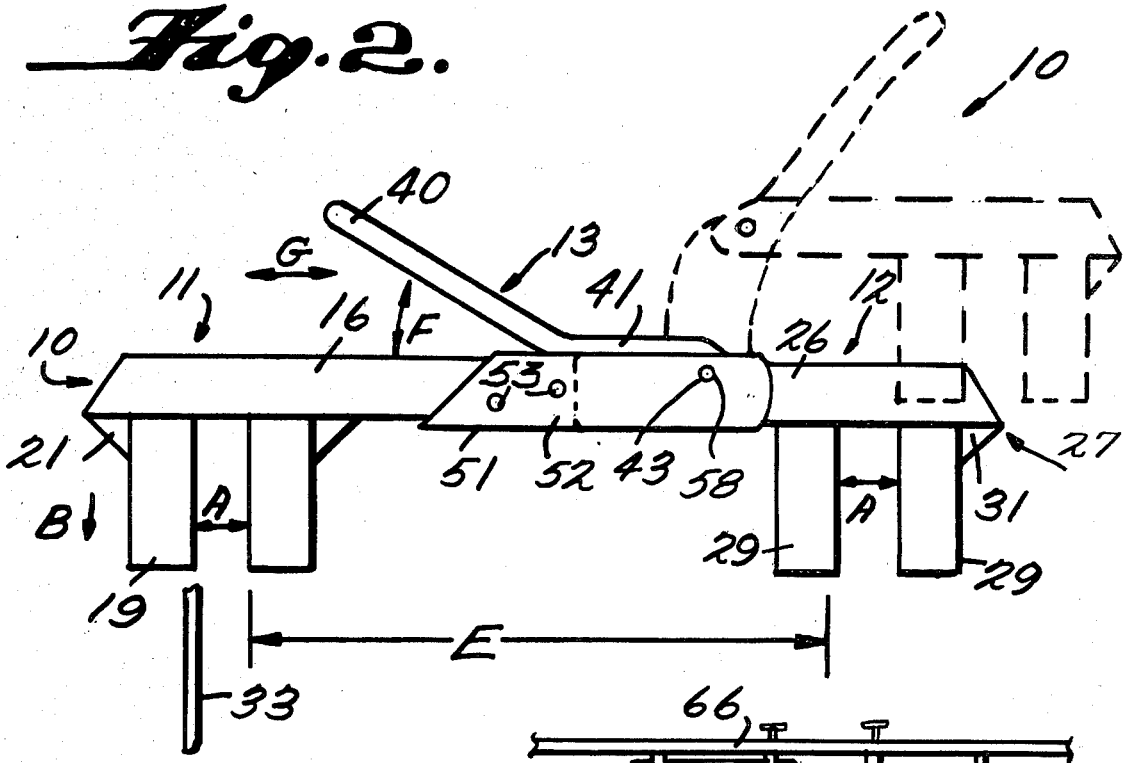
FIG. 2 is a side assembled view of the tool of FIG. 1, showing the tool in a first, locked position in solid line, and showing a second, unlocked position in dotted line.

A tool for holding and spacing structural members, according to the present invention, is shown generally by reference numeral 10 in the drawings. The tool comprises three major components, a first jaw assembly 11, a second jaw assembly 12, and a locking lever 13. Additionally, stop members 14 are provided for cooperation with the other components.

The first jaw assembly 11 includes a linear body portion 16 elongated in a predetermined dimension and having first and second ends 17, 18, respectively. A pair of stationary first jaws, spaced from each other a fixed predetermined distance A (see FIG. 2) are fixed to the body portion 16 adjacent the first end 17 thereof, and extend parallel to each other in the same direction B from the body portion 16. The first jaws 19 are welded, or otherwise attached to the body portion 16, and accessory plates 21 or the like may be provided for facilitating the welding action.

The body portion 16 and the jaws 19 can both be formed from rectangular-cross section tubing, or from plates that are welded to each other; they can be hollow. The materials of which they are formed may be lightweight (e.g. aluminum), and desirably are so for many of the preferred uses for the tool 10.

The second end 18 of the first jaw assembly body portion 16 is bifrucated, having a pair of arms 23 with the interior portions thereof spaced a distance C from each other. A pair of in-line through-extending openings 24 are provided in the arms 23.

The second jaw assembly 12 also includes a linear body portion 26 having first and second ends 27, 28 respectively. A pair of second jaws 29 are fixed to the body portion 26 and extend parallel to each other in the same direction (e.g. B) from the first end 27 of the body portion 26. Plates 31 may be provided to facilitate welding of the second jaws 29 to the body portion 26. The body portion 26 and the jaws 29 can also be formed from aluminum tubing, plates, or the like, just like the corresponding components for the first jaw assembly 11. Also the jaws 29 preferably are spaced from each other the same distance A as the first jaws 19, although there may be a difference between the spacings of the jaws 19 and 29, respectively, depending upon the particular structural components to be handled.

While the jaws 19, 29 have a fixed predetermined spacing A therebetween during use, the distance A may be made variable to accommodate different structural components. For instance, as illustrated in FIG. 2, a shim 33 may be provided for flush attachment to an interior face of a jaw 19, 29, to vary the spacing A. Also, under some circumstances, the jaws 19, 29 could be attached to the body 16, 26 respectively so that the positions therealong were adjustable by loosening of bolts, etcetera.

The second jaw assembly 12 body portion 26 second end 28 includes a central portion 34 that is relatively thin, having a pair of exterior faces 35 thereof spaced from each other a distance D, which is substantially less than the distance C. A through-extending opening 36 is formed in the central portion 34 adjacent the second end 28, and toward the bottom of the central portion 34.

The locking member 13 includes a handle 40 and a body 41. The body 41 is bifrucated, having a pair of arms 42, the arms 42 having an interior spacing approximately the same as (preferably slightly greater than) the distance D, and having the exterior portions thereof spaced a distance approximately the same as (preferably slightly less than) the distance C. A cylindrical post 43 extends outwardly from each of the arms 42, substantially perpendicular to the planes of the arms 42, the posts 43 being in-line and adapted to be received within the openings 24 of the first jaw assembly 11. An opening 44 is also formed in each of the arms 42, the openings 44 being in-line and adapted to cooperate with the opening 36 in the second jaw assembly 12. A pivot pin 45 passes through the openings 44, 36, and is retained therein.

Figure 1:
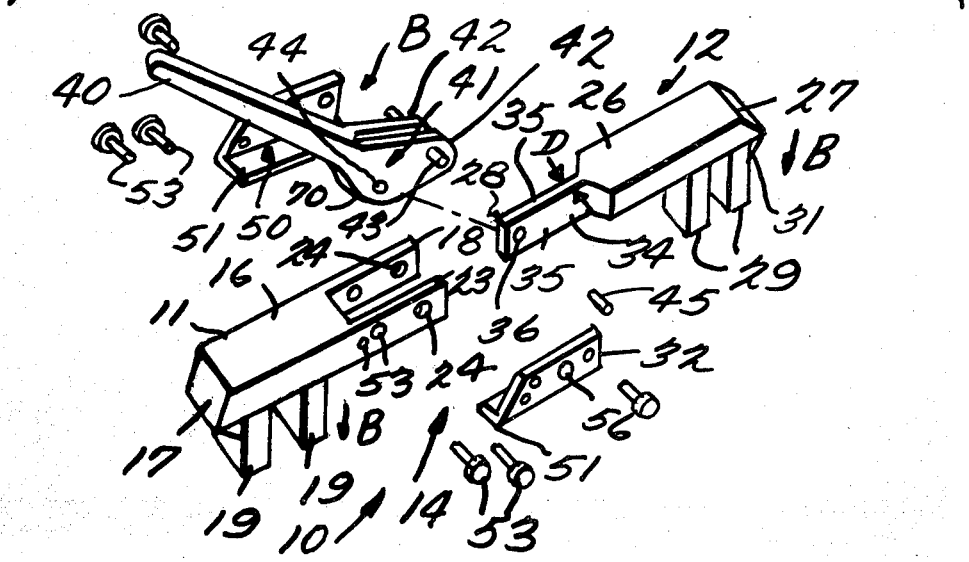
FIG. 1 is a perspective exploded view of an exemplary holding and spacing tool according to the invention.

From an inspection of FIGS. 1 and 2, it will be seen that the bifrucated second end 18 of the first jaw assembly 11, and the thin central portion 34 of the second end 28 of the second jaw assembly 12, provide cooperating surface means which allow overlap of the second ends 18, 28 of the first and second jaw assemblies 11, 12, respectively. The post 43 and cooperating openings 24, and the cooperating openings 44, 36 and pivot pin 45, provide means for pivotally mounting the locking lever 13 body 41 to the jaw assemblies 11, 12 second ends 18, 28 so that the jaw assemblies 11, 12 are movable from a first, locked position (solid line in FIG. 2) to a second, unlocked position (dotted line in FIG. 2).

In the locked position of the assemblies 11, 12 the body portion 16, 26 thereof are substantially in-line and the second ends 18, 28 thereof overlap. Also the first and second jaws 19, 29 are spaced from each other a fixed predetermined distance E. In the second, unlocked position, however, the body portion 16, 26 are not in-line, nor do the ends 18, 28 necessarily overlap, and the jaws 19, 29 are not spaced a fixed, predetermined distance from each other. As shown for the preferred embodiment illutrated in FIG. 2, in the unlocked position the jaws 29 are both vertically and horizontally displaced from their position when they are in the locked position.

The desired action and positioning between the assemblies 11, 12 is provided by particularly mounting the posts 43 and openings 44, and providing the openings 24, 36. In the first, locked position of the components, the pivotal connection (posts 23 and openings 24) between the locking lever 13 and the first jaw assembly 11 is actually closer to the second jaws 29 (in the dimension of elongation of the jaw assemblies 11, 12) than is the pivotal connection (openings 44, 36 and pivot pin 45) between the locking lever 13 and the second jaw assembly 12. Also, the pivotal connection provided by posts 43 and openings 24 is offset from the pivotal connection provided by openings 44, 36 and pivot pin 45 in a dimension F perpendicular to the dimension G of elongation of the body portion 16, 26, so that an overcenter action is provided.

In order to prevent the locking lever 13 from moving too far vis-a-vis the arms 23—and so that the locking lever 13 is maintained in an overcenter position locking assemblies 11, 12 so that the jaws 19, 29 are spaced a fixed predetermined distance E—the stop members 14 are provided. The stop members 14 may take a wide variety of forms, however for the preferred form illustrated in the drawings, the stop members 14 comprise a pair of brackets 50. Each bracket 50 includes a bottom portion 51 adapted to close off the spacing C between the arms 23 on the side thereof from which the jaws 19 extend (i.e. the "bottom" of the opening between the arms 23 when the tool 10 is in the locked position illustrated in FIG. 2). Each bracket 50 also includes a side portion 52 which is affixed to an exterior side of its cooperating arm 23, utilizing screws 53 or the like which pass through cooperating openings 54 in the sides 52 of the brackets 50, into opening 55 formed in the arms 23. Enlarged openings 56 are also provided in each of the bracket side plates 52, the openings 56 cooperating with the openings 24 to allow the posts 43 to pass to the exterior of the arms 23, wherein they are fixed in place by keys (see key 58 in FIG. 2) or the like.

Figure 3:
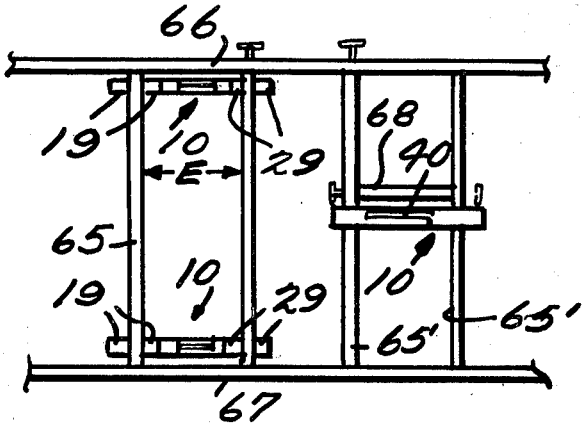
FIG. 3 is a schematic view illustrating use of a tool according to the invention in performing various holding and spacing functions.

Exemplary tools 10 according to the present invention are shown schematically in FIG. 3 in use for performing the various functions. In the upper left side in FIG. 3, a tool 10 is illustrated holding and spacing a distance E a pair of 2×4 wall studs 65 for direct nailing to a plate 66. At the bottom on the left-hand side of FIG. 3, a tool 10 is shown holding the joist 65 for toe-nailing to a sill 67. On the right-hand side of FIG. 3 a device 10 is illustrated holding a pair of wall studs 65' during bridging with a bridging stud 68.

A typical operation of a tool 10 according to the invention will now be described with respect to the stud 65 holding functions illustrated on the left-hand side of FIG. 3.

The tool 10 is assembled so that the central portion 34 of second jaw assembly 12 is received between the arms 42 of locking lever 13, and pivot pin 45 passes through openings 44, 36. The posts 43 pass through openings 24. The brackets 50 are attached to jaw assembly 11 by screws 53, with bottom plates 51 blocking off the bottom opening between the arms 23.

With the locking lever 13 in the position illustrated in dotted line in FIG. 2, one stud 65 is disposed between the jaws 19, and the other stud 65 is disposed between the jaws 29. The spacing A is substantially identical to the width (e.g. 1 and $\frac{7}{8}$ inches) of the studs 65. The studs 65 are moved generally into position between the sill and plate 67, 66, respectively, and by grasping the handle 40 the operator slowly moves it downwardly, pivoting the body 41 between the arms 23. Insuring that there is proper alignment of the studs 65 with the plate and sill 66 and/or 67, the operator then moves the handle 40 all the way toward the assembly 11, until a bottom portion 70 of the locking lever body 41 abuts the bottom plates 51. By this time, the pivot pin 49 has passed "overcenter" with respect to the pivot posts 43 in the dimension F, and the jaws 19, 29 are held in the locked position illustrated in solid line in FIG. 2. This action causes any bows or twists in the studs 65 to be straightened, and then the studs 65 are positively held with the proper spacing E so that the worker may then release the tool 10 and directly nail the studs 65 in place to the plate 66 and/or toe-nail the studs 65 to the bottom sill 67.

It will thus be seen that according to the present invention a simple and effective tool has been provided for the on-site holding and spacing of structural members, such as wall studs. While the invention has been herein shown and described in what is presently conceived to be the most practical and preferred embodiment thereof, it will be apparent to those of ordinary skill in the art that many modifications may be made thereof. For instance, under some circumstances the handle 40 may be connected to a powered component, such as a hydraulic cylinder; and the jaws 19, 29 may be mounted on the respective body portion 16, 26 so that the spacing E may be adjusted. Thus, the invention is to be accorded the broadest interpretation of the appended claims so as to encompass all equivalent tools and devices.

What is claimed is:

1. A tool for holding and spacing structural members, comprising:

a first jaw assembly including a linear body portion elongated in a predetermined dimension and a pair of stationary first jaws spaced from each other a fixed predetermined distance and extending parallel to each other in the same direction from a first end of said body portion, said direction substantially perpendicular to said dimension of elongation;

a second jaw assembly including a linear body portion elongated in a predetermined dimension and a pair of stationary second jaws spaced from each other a fixed predetermined distance and extending parallel to each other in the same direction from a first end of said body portion, said direction substantially perpendicular to said dimension of elongation;

a locking lever comprising a handle and a body;

cooperating surface means formed on second ends of said jaw assemblies, opposite said first ends, for providing overlap between said first and second jaw assembly body portions in the dimension of elongation thereof; and means for pivotally mounting said locking lever body to said first and second jaw assemblies body portions at spaced points adjacent the second ends thereof, so that the jaw assemblies are movable from a first, locked, substantially in-line position, with said locking lever body therebetween and said handle extending outwardly with said first and second jaws spaced from each other a fixed predetermined distance; to a second, unlocked, position wherein said jaw assemblies do not overlap and said jaw assembly body portions are not in-line, and said first and second jaws are not spaced a fixed, predetermined position from each other.

2. A tool as recited in claim 1 wherein when said jaw assemblies are in said first, locked, position thereof, the pivotal connection of said locking lever body to said first jaw assembly body portion is closer to said second jaws than the pivotal connection of said locking lever body to said second jaw assembly body portion.

3. A tool as recited in claim 2 wherein said pivotal connections of said locking lever body to said first and second jaw assembly body portions are offset from each other in a dimension perpendicular to the dimension of elongation of said jaw assembly body portions when in said first, locked, position, so that an overcenter action is provided.

4. A tool as recited in claim 2 wherein said first and second jaws are parallel to each other and extend in the same direction as each other.

5. A tool as recited in claims 1 or 4 wherein said cooperating surface means comprise: a bifrucated second end of said first jaw assembly, having a pair of arms spaced from each other a predetermined distance; a bifrucated locking lower body portion, having a pair of arms the exteriors of which are spaced from each other a distance approximately the same as the interiors of the arms of said first jaw assembly; and a central portion of said second jaw assembly body portion, having exterior surfaces spaced from each other a distance approximately the same as the spacing of the interiors of said locking lever arms from each other; and wherein in the first, locked, position of said assemblies, said arms of said locking lever are received between said arms of said first jaw assembly, and said second jaw assembly central portion is received between said locking lever arms.

6. A tool as recited in claim 5 wherein said means for pivotally mounting said locking lever body to said first jaw assembly comprises an in-line pair of posts, one extending outwardly from each of said locking lever arms perpendicular to said arms; and a pair of in-line openings formed in said first jaw assembly arms for receipt of said posts.

7. A tool as recited in claim 6 wherein said means for pivotally mounting said locking lever body to said second jaw assembly comprises an in-line pair of through-extending openings formed in said locking lever arms, and a cooperating opening formed in said second jaw assembly central portion; and a pivot pin extending through said openings.

8. A tool as recited in claim 5 further comprising a pair of stop members fixed to said first jaw assembly and blocking off the opening between the arms thereof on a side of the arms from which said first jaws extend.

9. A tool for holding and spacing structural members, comprising:

a first jaw assembly including a linear body portion elongated in a predetermined dimension and having first and second ends; a pair of stationary first jaws spaced from each other a fixed predetermined distance and extending parallel to each other in the same direction from the first end of the body portion; the second end of the body portion being bifrucated, having a pair of arms spaced from each other a predetermined distance;

a locking lever comprising a handle and a body, said body being bifrucated, having a pair of arms the exteriors of which are spaced from each other a distance approximately the same as the predetermined spacing of the interiors of the arms of said first jaw assembly;

a second jaw assembly including a linear body portion elongated in a predetermined dimension, and having first and second ends; a pair of stationary second jaws spaced from each other a fixed predetermined distance and extending parallel to each other in the same direction from the first end of said body portion; and said second end of said body portion having a thinned central portion having exterior surfaces spaced from each other a distance approximately the same as the spacing of the interiors of said locking lever arms;

stop means closing off the space between said first jaw assembly arms on a side of said first assembly body portion from which said first jaws extend; and means for pivotally mounting said locking lever body to said first and second jaw assemblies body portions at spaced points adjacent the second ends thereof.

10. A tool as recited in claims 1 or 9 wherein said first and second jaw assemblies are made of aluminum tubing.

* * * * *